US009228592B2

(12) United States Patent
Ryuzaki et al.

(10) Patent No.: US 9,228,592 B2
(45) Date of Patent: Jan. 5, 2016

(54) BLOWING DEVICE, AND IMAGE FORMING APPARATUS

(71) Applicant: FUJI XEROX CO., LTD., Tokyo (JP)

(72) Inventors: Teruyo Ryuzaki, Kanagawa (JP); Yuki Nagamori, Kanagawa (JP); Kazuki Inami, Kanagawa (JP); Yasunori Momomura, Kanagawa (JP); Masafumi Kudo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/038,170

(22) Filed: Sep. 26, 2013

(65) Prior Publication Data

US 2014/0294580 A1 Oct. 2, 2014

(30) Foreign Application Priority Data

Mar. 26, 2013 (JP) ..... 2013-063583

(51) Int. Cl.

| | |
|---|---|
| ***G03G 21/20*** | (2006.01) |
| ***F04D 29/40*** | (2006.01) |
| ***F04D 29/44*** | (2006.01) |

(52) U.S. Cl.

CPC ..... *F04D 29/403* (2013.01); *F04D 29/441* (2013.01); *G03G 2221/1645* (2013.01)

(58) Field of Classification Search

USPC ..... 399/92

See application file for complete search history.

(56) References Cited

U.S. PATENT DOCUMENTS

| | | | | |
|---|---|---|---|---|
| 5,531,484 | A * | 7/1996 | Kawano | 285/179.2 |
| 6,026,275 | A * | 2/2000 | Matsuzoe et al. | 399/335 |
| 6,361,431 | B1 * | 3/2002 | Kawano | 454/228 |
| 6,466,440 | B2 * | 10/2002 | Kaneko | 361/690 |
| 8,346,116 | B2 * | 1/2013 | Tsuda et al. | 399/92 |
| 2006/0045558 | A1 * | 3/2006 | Nishida et al. | 399/93 |
| 2010/0181717 | A1 | 7/2010 | Sumikura | |
| 2011/0121510 | A1 | 5/2011 | Tsuda et al. | |
| 2011/0277969 | A1 * | 11/2011 | Chang | 165/121 |

FOREIGN PATENT DOCUMENTS

| | | | |
|---|---|---|---|
| JP | S62-228832 | A | 10/1987 |
| JP | H07-134532 | A | 5/1995 |
| JP | H07-269524 | A | 10/1995 |
| JP | 2000-055435 | A | 2/2000 |
| JP | A-2000-137425 | | 5/2000 |
| JP | A-2001-331016 | | 11/2001 |
| JP | 2003-270911 | A | 9/2003 |
| JP | 2006-071701 | A | 3/2006 |

(Continued)

OTHER PUBLICATIONS machine translation: Kagawa, JP2006-276175A.*

(Continued)

*Primary Examiner* — W B Perkey
*Assistant Examiner* — Linda B Smith
(74) *Attorney, Agent, or Firm* — Oliff PLC

(57) ABSTRACT

Provided is a blowing device including a blower that sends air, a blower pipe having an inlet that takes in the air sent from the blower, an outlet that is formed in an elongated opening shape parallel to the portion of the target structure in the longitudinal direction, and a body portion that connects the inlet and the outlet and to cause the air to flow therethrough, and plural flow dividing plates, each of the flow dividing plates having a distributing portion and a changing portion.

11 Claims, 10 Drawing Sheets

(56) References Cited

FOREIGN PATENT DOCUMENTS

| | | | |
|---|---|---|---|
| JP | B2-3926962 | | 6/2007 |
| JP | 2010-169860 | A | 8/2010 |
| JP | 2011-112784 | A | 6/2011 |
| JP | B2-4760085 | | 8/2011 |

OTHER PUBLICATIONS machine translation: Sekida, JP2001-331016A.*
Sep. 1, 2015 Office Action issued in Japanese Patent Application No. 2013-063583.

* cited by examiner

BLOWING DEVICE, AND IMAGE FORMING APPARATUS

CROSS-REFERENCE TO RELATED APPLICATIONS

This application is based on and claims priority under 35 USC 119 from Japanese Patent Application No. 2013-063583 filed Mar. 26, 2013.

BACKGROUND (i) Technical Field

The present invention relates to a blowing device, and an image forming apparatus.

(ii) Related Art

In image forming apparatuses that form an image constituted by a developer on a recording sheet, for example, there is an image forming apparatus using a corona discharge device that performs corona discharge in the process of charging a latent image holding body, such as a photoconductor, or the process of neutralization, the process of transferring an unfixed image to the recording sheet, or the like.

Additionally, in the corona discharge device, in order to prevent unnecessary substances, such as paper debris or a discharge product, from adhering to component parts, such as a discharging wire or a grid electrode, a blowing device that blows air against component parts may be provided together. The blowing device in this case is generally constituted by a blower that sends air, and a duct (blower pipe) that guides and sends out the air sent from the blower up to a target structure, such as a corona discharge device.

In the related art, various improvements for enabling air to be uniformly blown in the longitudinal direction of the component parts, such as a discharging wire, are performed on the blowing device or the like. Particularly, as such a blowing device or the like, there are proposed the following blowing devices that adopt a configuration in which the shape of a passage space of a duct through which air flows is formed in a special shape or a configuration in which a straightening plate or the like that adjusts a direction in which air flows is disposed in the passage space of the duct, or the like.

SUMMARY

According to an aspect of the invention, there is provided a blowing device including:

a blower that sends air;

a blower pipe having an inlet that takes in the air sent from the blower, an outlet that is arranged so as to face a portion, in the longitudinal direction, of an elongated target structure against which the air taken in from the inlet is to be blown and that is formed in an elongated opening shape parallel to the portion of the target structure in the longitudinal direction, and a body portion that connects the inlet and the outlet and to cause the air to flow therethrough; and plural flow dividing plates, each of the flow dividing plates having a distributing portion that has an edge and is arranged so as to be substantially parallel to the longitudinal direction of the elongated target structure and distributes the air taken in from the inlet, and a changing portion that is arranged so as to be substantially orthogonal to the longitudinal direction of the elongated target structure and changes the direction of the flow of air distributed by the distributing portion, wherein each of the edge positions of the distribution portions is different from each other in position along the longitudinal direction.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to the drawings.

First Exemplary Embodiment

Figure 1:
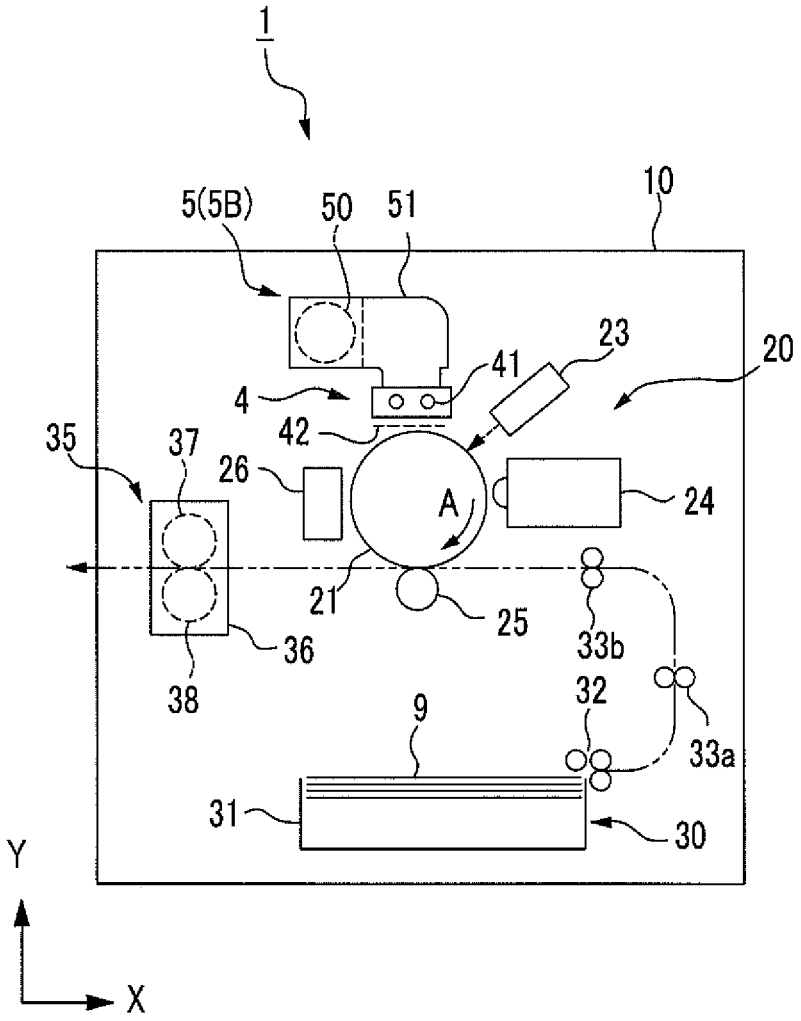
FIG. 1 is a schematic configuration view showing an image forming apparatus to which a blowing device related to a first exemplary embodiment of the invention is applied.
Figure 2:
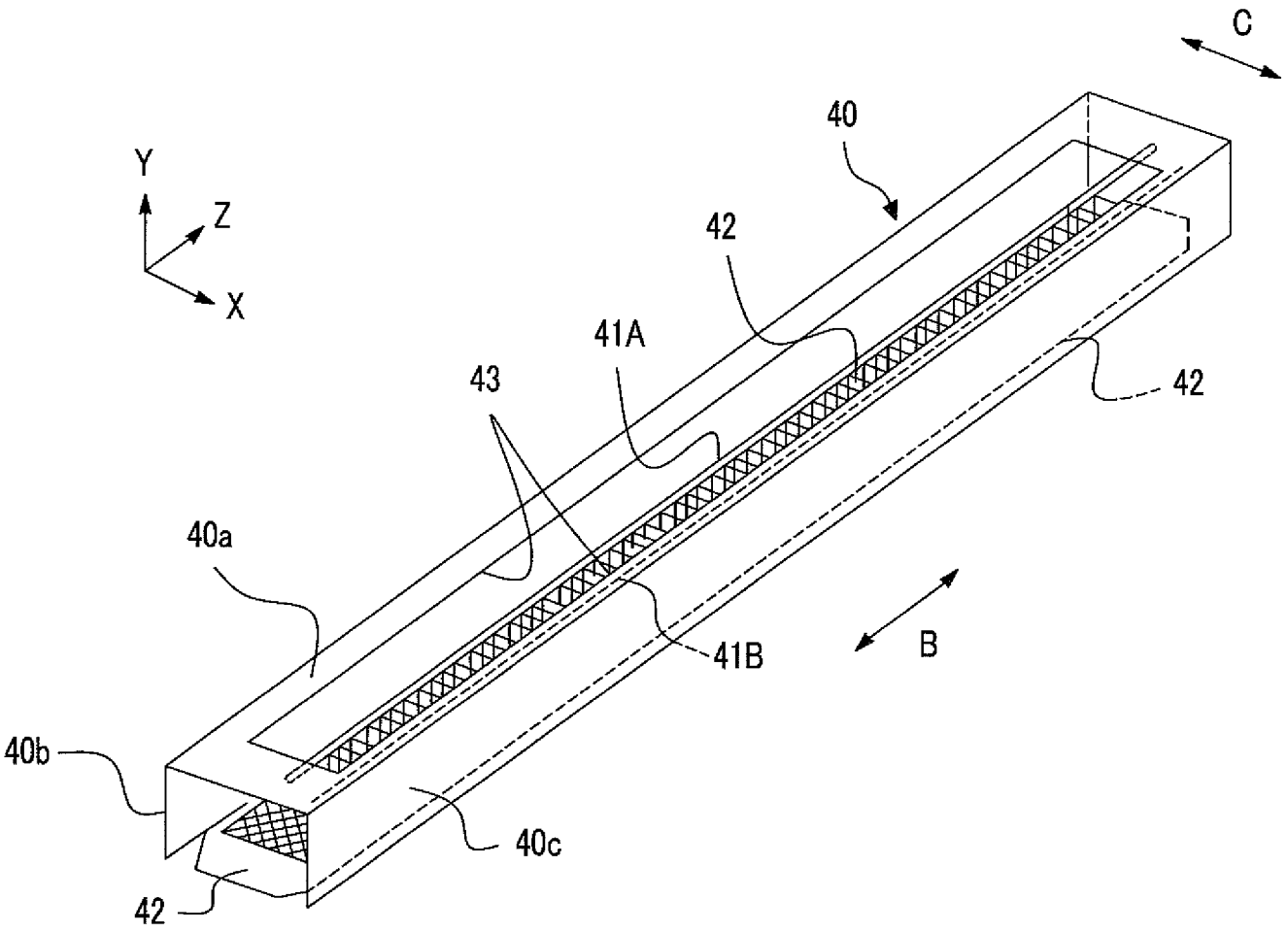
FIG. 2 is a perspective view showing a charging device.
Figure 3:
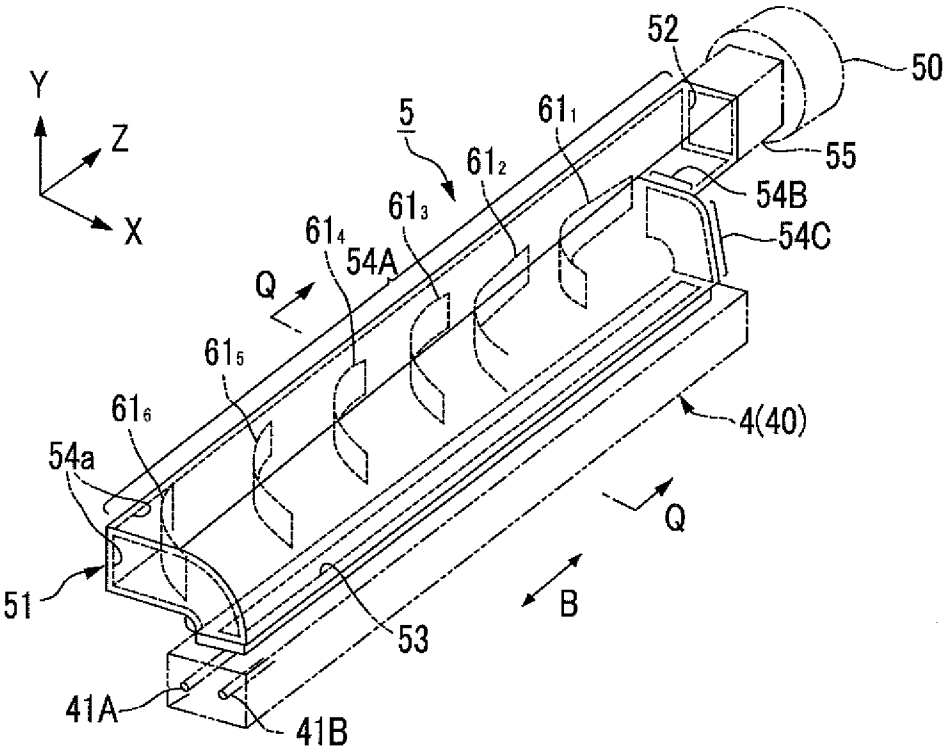
FIG. 3 is a perspective view showing a blowing device.

FIGS. 1 and 2 show an image forming apparatus to which a blowing device related to the first exemplary embodiment is applied. FIG. 1 shows the outline of the overall image forming apparatus, FIG. 2 shows a charging device as a target structure that is used for the image forming apparatus and against which air is to be blown by the blowing device, and FIG. 3 shows the outline of the blowing device.

In the image forming apparatus 1, as shown in FIG. 1, an image forming unit 20 that forms a toner image constituted by toner as a developer to transfer the toner image to a sheet 9 as an example of a recording material, a sheet feeding device 30 that accommodates and transports sheets 9 to be supplied to the image forming unit 20, and a fixing device 35 that fixes the toner image formed by the image forming unit 20 on a sheet 9 are installed in an internal space of a housing 10 constituted by a support frame, a sheathing cover, or the like. Although only one image forming unit 20 is illustrated in the first exemplary embodiment, plural image forming units may be used.

The above image forming unit 20 is configured, for example utilizing a well-known electrophotographic system, and is mainly constituted by a photoconductor drum 21 that is rotationally driven in a direction (a clockwise direction in the drawing) indicated by arrow A, a charging device 4 that charges a peripheral surface that becomes an image formation region of the photoconductor drum 21 with required potential, an exposure device 23 that irradiates the surface of the photoconductor drum 21 after the charging with light (dotted line with an arrow) based on image information (signal) input from the outside and forms an electrostatic latent image with a potential difference, a developing device 24 that develops the electrostatic latent image as a toner image with a toner, a transfer device 25 that transfers the toner image to a sheet 9, and a cleaning device 26 that removes the toner or the like that remains on the surface of the photoconductor drum 21 after the transfer.

Among these, a corona discharger is used as the charging device 4. The charging device 4 including this corona discharger, as shown in FIG. 2 or the like, includes a shielding case 40 as a cover member that is arranged along the axial direction of the photoconductor drum 21. The shielding case 40 has an external shape having an oblong top plate 40*a* that extends along the axial direction of the photoconductor drum 21 and side plates 40*b* and 40*c* that hang downward from long side portions that extend along the longitudinal direction B of the top plate 40*a*, and has an opening at an lower end portion that faces the photoconductor drum 21. Supporting members (not shown) are respectively attached to both ends (short side portions) in the longitudinal direction B of the shielding case 40, and single or plural (two in the illustrated example) corona discharging wires (ignition electrode) 41A and 41B are attached to the supporting members so as to pass through the internal space of the shielding case 40 and stretch substantially linearly along the axial direction of the photoconductor drum 21. Additionally, the charging device 4 constitutes a so-called scorotron type corona discharger that has a grid-like grid electrode (electric field adjustment plate) 42, which is attached so as to be present between the discharging wires 41A and 41B and the peripheral surface of the photoconductor drum 21, at the lower opening of the shielding case 40. Reference numeral 40*d* shown in FIG. 4 or the like represents a partition wall (partition member) that partitions the space where the two corona discharging wires 41A and 41B are arranged.

Additionally, the charging device 4 is arranged such that the corona discharging wires 41A and 41B are present at least in an image forming target region along the direction of a rotation axis of the photoconductor drum 21 in a state where the wires face the peripheral surface of the photoconductor drum 21 at a required interval (for example, a discharge gap). Additionally, the charging device 4 is adapted such that charging voltages are applied to the corona discharging wires 41A and 41B (between the wires and the photoconductor drum 21) from a power unit (not shown) when an image is formed. In addition, in the charging device 4, a voltage for adjusting the charging potential of the photoconductor drum 21 is applied from the power unit (not shown) to the grid electrode 42.

Moreover, with the use of the charging device 4, substances (unnecessary substances), such as debris of a sheet 9, a discharge product generated by corona discharge, and external additives of toner adhere to and contaminate the corona discharging wires 41 and the grid electrode 42, and the corona discharge is no longer sufficiently or uniformly performed. As a result, poor charging, such as uneven charging, may occur. For this reason, in order to prevent or keep unnecessary substances from adhering to the corona discharging wires 41A and 41B and the grid electrode 42, a blowing device (not shown) for blasting air against the corona discharging wires 41A and 41B and the grid electrode 42 is provided together at the charging device 4. Additionally, a top plate 40*a* of the shielding case 40 of the charging device 4 is formed with an opening 43 for taking in the air from the blowing device 5. The opening 43 is formed so that the opening shape thereof becomes oblong. In addition, the blowing device 5 will be described below in detail.

The sheet feeding device 30 includes a sheet accommodation body 31 of a tray type, a cassette type, or the like that accommodates plural sheets 9 having a required size, required kind, or the like to be used for formation of an image, in a stacked state, and a delivery device 32 that delivers the sheets 9 accommodated in the sheet accommodation body 31 one by one toward a transporting path. If the timing for sheet feeding comes, the sheets 9 are delivered one by one. Plural sheet accommodation bodies 31 are provided according to utilization modes. A two-dot chain line with an arrow in FIG. 1 shows a transporting path which a sheet 9 is mainly transported along and passes through. This transporting path for sheets 9 is constituted by plural sheet transporting roll pairs 33*a* and 33*b*, transporting guide members (not shown), or the like.

The fixing device 35 includes, inside a housing 36 formed with an introduction port and an discharge port through which a sheet 9 passes, a roll-shaped or belt-shaped heating rotary body 37 of which the surface temperature is heated to and maintained at a required temperature by a heating unit, and a roll-shaped or belt-shaped pressurizing rotary body 38 that is rotationally driven in contact with the heating rotary body 37 at a required pressure substantially along the direction of the axis of the heating rotary body 37. The fixing device 35 allows a sheet 9 after a toner image is transferred to be introduced into and pass through a fixing treatment section formed between the heating rotary body 37 and the pressurizing rotary body 38, thereby performing fixing.

Image formation using the image forming apparatus 1 is performed as follows. Here, a basic image forming operation when an image is formed on one side of a sheet 9 will be described as an example.

In the image forming apparatus 1, if the control device or the like receives a start command for an image forming operation, in the image forming unit 20, the peripheral surface of the photoconductor drum 21 that starts to rotate is charged with predetermined polarity and potential by the charging device 4. At this time, in the charging device 4, corona discharge is generated in a state where charging voltages are applied to the corona discharging wires 41, and an electric field is formed between the discharging wires 41 and the peripheral surface of the photoconductor drum 21, and thereby, the peripheral surface of the photoconductor drum 21 is charged with required potential. In this case, the charging potential of the photoconductor drum 21 is adjusted by the grid electrode 42.

Subsequently, an electrostatic latent image, which is configured with a required potential difference as exposure is performed on the basis of image information from the exposure device 23, is formed on the peripheral surface of the charged photoconductor drum 21. Thereafter, when the electrostatic latent image formed on the photoconductor drum 21 passes through the developing device 24, the electrostatic latent image is developed with toner that is supplied from a developing roll 24*a* and charged with required polarity, and is visualized as a toner image.

Next, if the toner image formed on the photoconductor drum 21 is transported to a transfer position that faces the transfer device 25 by the rotation of the photoconductor drum 21, the toner image is transferred by the transfer device 25 to a sheet 9 to be supplied through a transporting path from the sheet feeding device 30 according to this timing. The peripheral surface of the photoconductor drum 21 after this transfer is cleaned by the cleaning device 26.

Subsequently, the sheet 9 to which the toner image is transferred in the image forming unit 20 is transported so as to be introduced into the fixing device 35 after being separated from the photoconductor drum 21, and is heated and pressurized when passing in-between the heating rotary body 37 and the pressurizing rotary body 38 in the fixing device 35, whereby the toner image melts and is fixed on the sheet 9. The sheet 9 after this fixing is completed is ejected from the fixing device 35, and is transported to and accommodated in an ejected sheet accommodation section (not shown) or the like that is formed, for example outside the housing 10.

As described above, a monochrome image formed by a single-color toner is formed on one side of one sheet 9, and the basic image forming operation is completed. When there is an instruction for the image forming operation for plural sheets, a series of operations as described above are similarly repeated by the number of sheets.

Next, the blowing device 5 will be described.

As shown in FIG. 1, 3, or the like, the blowing device 5 includes a blower 50 that has a rotary fan that sends air, and a blower duct 51 that takes in the air sent from the blower 50 and guides and blows off the air up to the charging device 4 that is an object to be blown.

As the blower 50, for example, a radial flow type blower fan is used and the driving thereof is controlled so as to send a required volume of air. Additionally, the blower duct 51, as shown in FIGS. 3 to 6, is formed in a shape having an inlet 52 that takes in the air sent from the blower 50, an outlet 53 that is arranged in a state where the outlet faces the portion (the top plate 40*a* of the shielding case 40), in the longitudinal direction B, of the elongated charging device 4 against which the air taken in from the inlet 52 is to be blown, and sends the air so as to flow along a direction orthogonal to the longitudinal direction B, and a body portion 54 formed with a passage space 54*a* for connecting the inlet 52 and the outlet 53 to cause air to flow therethrough.

The body portion 54 of the blower duct 51, as shown in FIG. 3, has one end portion provided with the inlet 52 and opened and the other end portion closed, and the body portion is constituted by an angular-tube-shaped introduction passage portion 54A the whole body of which is formed so as to extend along the longitudinal direction of the charging device 4, an angular-tube-shaped first bent passage portion 54B formed so as to extend after being bent almost at a right angle to a substantially horizontal direction (direction substantially parallel to the coordinate axis X) in a state where the width of the passage space is increased from a portion near the other end portion of the introduction passage portion 54A, and second bent passage portions 54C formed so as to extend toward the charging device 4 after being bent in a downwardly vertical direction (direction substantially parallel to the coordinate axis Y) in a state where the width of the passage space remains equal from one end portion of the first bent passage portion 54B. A termination end portion of the second bent passage portion 54C is formed with the outlet 53 having an opening shape that is the same as the cross-sectional shape of the passage space of the termination end portion. The widths (dimensions along the longitudinal direction B) of both the passage spaces 54*a* of the first bent passage portion 54B and the second bent passage portion 54C are set to almost the same dimension as each other.

The inlet 52 of the blower duct 51 is formed so that the opening shape thereof becomes substantially square. A connection duct 55 for connecting between the blower duct 51 and the blower 50 to send the air from the blower 50 to the inlet 52 of the blower duct 51 is attached to the inlet 52 (FIG. 3). Additionally, the outlet 53 of the blower duct 51 is formed so that the opening shape thereof becomes an elongated shape (for example, oblong shape) parallel to the portion of the charging device 4 in the longitudinal direction B. For this reason, the blower duct 51 has the relationship where the inlet 52 and the outlet 53 are formed in mutually different opening shapes. In addition, even in a case where the inlet 52 and the outlet 53 have the same shape, a case where the inlet and the outlet are formed so as to have mutually different opening areas (when the inlet and outlet have a similar shape) is included in the relationship where the inlet and the outlet are formed in mutually different opening shapes.

Here, in the blower duct 51 in which the inlet 52 and the outlet 53 are formed in mutually different opening shapes in this way, the portion in which the cross-sectional shape of the passage space 54*a* is changed on the way is present in the body portion 54 that connects between the inlet 52 and the outlet 53. Incidentally, in the blower duct 51, the cross-sectional shape of the passage space 54*a* having a substantially square shape, of the introduction passage portion 54A is changed to the cross-sectional shape of the passage space 54*a* having oblong shape that spreads only in the horizontal direction (irrespective of height) in the first bent passage portion 54B. In other words, the cross-sectional shape of the passage space 54*a* of the introduction passage portion 54A is the cross-sectional shape of the passage space 54*a* that abruptly becomes wide in the first bent passage portion 54B.

Additionally, in the case of the blower duct 51 in which such a portion in which the cross-sectional shape of the passage space 54*a* changes is present, disturbance, such as separation or vortex, occurs in the flow of air in the portion in which the cross-sectional shape changes. For this reason, even if air with a uniform wind speed is taken in from the inlet 52, the wind speed of the air that comes out from the outlet 53 tends to become non-uniform. In addition, the tendency that the wind speed of the air that comes out from the outlet 53 becomes non-uniform eventually in this way occurs similarly even in a case where a direction in which the air in the blower duct 51 is caused to flow (travel) changes irrespective of the presence of a change in the cross-sectional shape of the passage space 54*a*.

Figure 5:
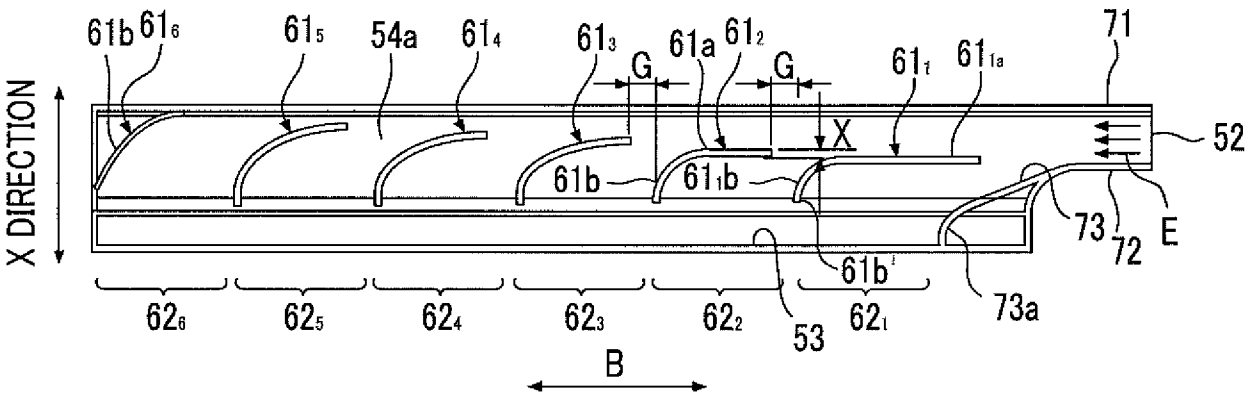
FIG. 5 is a plan configuration view showing the blowing device.

Thus, the blowing device 5, as shown in FIG. 3, FIG. 5, and the like, has flow dividing plates $\mathbf{61}_1$ to $\mathbf{61}_6$ as plural flow dividing members, which are arranged along the longitudinal direction B of the charging device 4, in the passage space 54*a* of the body portion 54 of the blower duct 51. Additionally, the outlet 53 of the blower duct 51 is divided into plural (six in the illustrated example) blowoff regions $\mathbf{62}_1$ to $\mathbf{62}_6$ at equal intervals along the longitudinal direction B of the charging device 4. The above respective flow dividing plates $\mathbf{61}_1$ to $\mathbf{61}_6$ cause the air taken in from the inlet 52 to flow so as to be distributed to one blowoff region 62 among the plural blowoff regions $\mathbf{62}_1$ to $\mathbf{62}_6$ divided in the longitudinal direction B of the charging device 4 and regions downstream of the one blowoff region 62. The plural flow dividing plates $\mathbf{61}_1$ to $\mathbf{62}_6$ are provided in the passage space 54*a* of the body portion 54 so as to correspond to the plural blowoff regions $\mathbf{62}_1$ to $\mathbf{62}_6$. Each of the edge positions of the flow dividing plates is different from each other in position along the longitudinal direction. Additionally, since a required gap G is set along the longitudinal direction B of the charging device 4 between the above respective flow dividing plates 61, the respective flow dividing plates 61 are arranged so as be positionally shifted from each other with no overlap along the longitudinal direction B of the charging device 4.

As shown in FIG. 5, since a narrow flow channel is eliminated by keeping distributing portions 61*a* of the adjacent flow dividing plates 61 from overlapping each other at the same position in the longitudinal direction, pressure loss is reduced.

Figure 6:
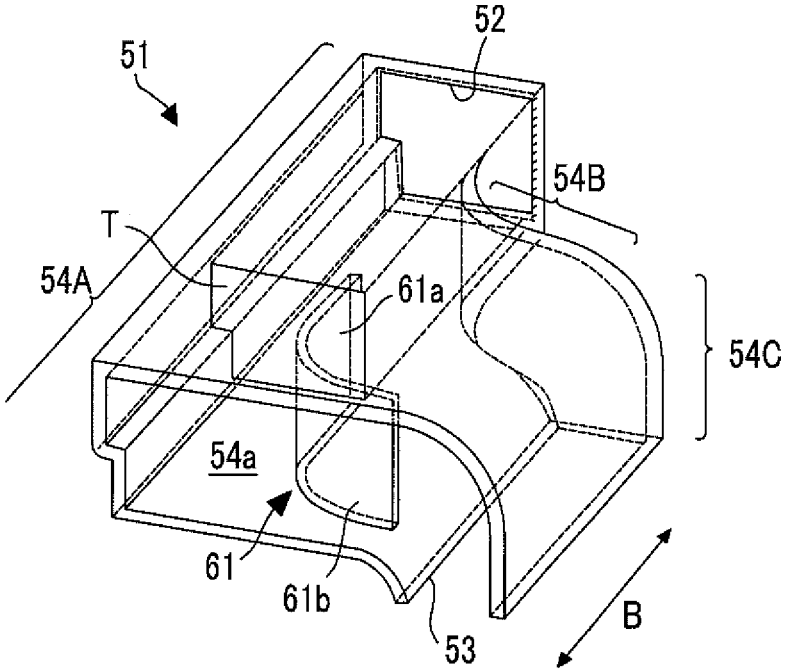
FIG. 6 is a perspective configuration view showing a blower duct.

Each of the above flow dividing plates $\mathbf{61}_1$ to $\mathbf{61}_6$, as shown in FIG. 6, is provided from the introduction passage portion 54A to the first bent passage portion 54B in the passage space 54*a* of the body portion 54 of the blower duct 51, and includes a distributing portion 61*a* that is arranged so as to be orthogonal to a projection plane T obtained by projecting the opening shape of the inlet 52 along the longitudinal direction B of the charging device 4 and distributes the air taken in from the inlet 52, and a changing portion 61*b* that changes the direction (wind direction) of the flow of air distributed by the distributing portion 61*a* to one blowoff region 62 among the plural blowoff regions $\mathbf{62}_1$ to $\mathbf{62}_6$ corresponding to the flow dividing plate 61 concerned.

The distributing portion 61*a* of each flow dividing plate is formed in the shape of a flat plate, is erected perpendicularly to a bottom surface that constitutes the introduction passage portion 54A of the passage space 54*a* of the body portion 54 so as to be orthogonal to the projection plane obtained by projecting the opening shape of the inlet 52 along the longitudinal direction B of the charging device 4, and is arranged along the longitudinal direction B of the charging device 4. As a result, the introduction passage portion 54A is partitioned by the distributing portion 61*a* that is present between the bottom surface and ceiling surface of the introduction passage portion 54A.

Additionally, as shown in FIG. 5, the distributing portions 61*a* of the respective flow dividing plates 61 are provided so as to be present parallel to each other at a required distance x from each other along the direction (X-direction) orthogonal to the longitudinal direction B of the charging device 4, and are arranged at positions apart from the outlet 63 as the flow dividing plates 61 are closer to the downstream side. Although the distances x are set to, for example, the same value in the respective flow dividing plates 61, all of the distances may not be necessarily set to the same value and some or all of the distances may be set to different values. The distance x of the distributing portions 61*a* of the above adjacent flow dividing plates 61 determines the amount of air to be distributed to the blowoff region 62 corresponding to the flow dividing plate 61 located on the downstream side out of the two adjacent flow dividing plates 61.

Additionally, the changing portion 61*b* of each of the flow dividing plates 61, as shown in FIGS. 3 to 6, is arranged so as to be present between the introduction passage portion 54A and the first bent passage portion 54B, and is provided so as to be integrally continuous with the downstream side of the distributing portion 61*a*. In more detail, similar to the distributing portion 61*a*, the changing portion 61*b* of each of the flow dividing plates 61 is arranged between the bottom surface and the ceiling surface that form the passage space 54*a* of the body portion 54 so as to partition the passage space 54*a*. Additionally, the changing portion 61*b* of each flow dividing plate 61 is formed, for example, in a curved shape, such as a substantially circular-arc shape in a plan view, so that the direction (wind direction) of air distributed by the distributing portion 61*a* is changed to one corresponding blowoff region 62 among the plural blowoff regions $\mathbf{62}_1$ to $\mathbf{62}_6$. Additionally, the changing portion 61*b* of each of the flow dividing plates 61 is set so that the curvature radius thereof become sequentially large as it goes to the downstream side in a direction along the longitudinal direction B of the charging device 4.

In addition, since the flow dividing plate $\mathbf{61}_6$ located nearest to the downstream side does not need to distribute air to the downstream side further than the flow dividing plate 61 concerned, the distributing portion 61*a* of the flow dividing plate 61 is formed integrally with a side wall 71 that forms the introduction passage portion 54A of the body portion 54 (a side wall 71 of the introduction passage portion 54A serves also as the distributing portion 61*a*).

In the introduction passage portion 54A of the body portion 54 of the above blower duct 51, as shown in FIG. 5, one side wall 71 of the inlet 52 along the X-direction orthogonal to the longitudinal direction B of the charging device 4 is formed in the shape of a flat plate from an end portion on the inlet 52 side to a blocked end portion on the depth side. In contrast, in the other side wall 72 of the inlet along the X-direction orthogonal to the longitudinal direction B of the charging device 4, a region nearest to the inlet 52 in a region ranging from the introduction passage portion 54A to the first bent passage portion 543 is a portion where the opening width of the introduction passage portion 54A increases abruptly, and becomes a region where the air taken in from the inlet 52 separates from the inner wall surface of the first bent passage portion 543, and a vortex or the like tends to be generated.

Therefore, in the present exemplary embodiment, the region where the opening width increases abruptly from the introduction passage portion 54A to the first bent passage portion 54B is provided with an inclination wall 73 that is arranged so as to extend from the side wall 72 of the introduction passage portion 54A via the first bent passage portion 54B to the second bent passage portion 54C. The inclination wall 73 is arranged ranging from the first bent passage portion 54B to the second bent passage portion 54C so as to incline with respect to the introduction passage portion 54A, and a rear end portion 73*a* thereof is formed in a shape that is curved in the direction orthogonal to the longitudinal direction B of the charging device 4 inside the second bent passage portion 54C. By providing the inclination wall 73 inside the blower duct 51 in this way, the opening length of the outlet 53 along the longitudinal direction of the charging device 4 is set to be shorter than the total length of the second bent passage portion 54C by a length equivalent to a region where the inclination wall 73 is provided. In addition, the blowoff regions 62 are regions formed in consideration of the region where the inclination wall 73 is provided.

Next, the configuration of the respective flow dividing plates will be described in detail.

The first flow dividing plate $\mathbf{61}_1$ located nearest to the upstream side along the longitudinal direction of the charging device 4 among the above plural flow dividing plates $\mathbf{61}_1$ to $\mathbf{61}_6$ distributes the air taken in from the inlet 52 into the air that blows off from the first blowoff region $\mathbf{62}_1$ and the air that flows to regions (second to sixth blowoff regions) downstream of the first blowoff region $\mathbf{62}_1$, and changes the direction of the distributed air to the corresponding first blowoff region $\mathbf{62}_1$ so as to flow to the first blowoff region.

The distributing portion 61*a* of the first flow dividing plate 61, as is shown in FIG. 5, is formed so as to be longer than the other distributing portions 61*a*, and the tip of the first flow dividing plate extends to a position corresponding to an intermediate portion of the inclination wall 73. Additionally, the position of the distributing portion 61*a* of the first flow dividing plate 61 in the direction orthogonal to the longitudinal direction B of the charging device 4 is set so that the distributing portion 61*a* distributes the air taken in from an inlet 52 into the air that blows off from the first blowoff region $\mathbf{62}_1$ and the air that flows to the regions (second to sixth blowoff regions) downstream of the first blowoff region $\mathbf{62}_1$ for example, in a ratio of 1:5 by amount.

Additionally, the changing portion 61*b* of the first flow dividing plate 61 has a smallest curvature radius as compared to the other changing portions 61*b*. Moreover, a rear end portion 61*b*' of the changing portion 61*b* of the first flow dividing plate 61, similar to the other flow dividing plates, is formed in the shape of a short flat plate toward the direction orthogonal to the longitudinal direction of the charging device 4.

Additionally, the second flow dividing plate $\mathbf{61}_2$ is arranged with a gap G with respect to a downstream end portion of the changing portion 61*b* of the first flow dividing plate $\mathbf{61}_1$. The distributing portion 61*a* of the second flow dividing plate $\mathbf{61}_2$ is provided so as to be present at the distance x in the direction orthogonal to the longitudinal direction B of the charging device 4 with respect to the distributing portion 61*a* of the first flow dividing plate $\mathbf{61}_1$. Additionally, the position of the distributing portion 61*a* of the second flow dividing plate $\mathbf{61}_2$ in the direction orthogonal to the longitudinal direction B of the charging device 4 is set so that the distributing portion 61*a* distributes air distributed by the first flow dividing plate $\mathbf{61}_1$ into the air that blows off from the second blowoff region $\mathbf{62}_2$ and the air that flows to regions (third to sixth blowoff regions) downstream of the second blowoff region $\mathbf{62}_2$ for example, in a ratio of 1:4 by amount.

In addition, the flow dividing plates after the third flow dividing plate are also similarly configured basically.

The operation of the blowing device 5 will be described below.

If the blowing device 5 arrives at a driving setting timing, such as an image forming timing, first, the blower 50 is rotationally driven to send out a required volume of air. The air sent from the started blower 50 is taken into the passage space 54*a* of the body portion 54 through the connection duct 55 from the inlet 52 of the blower duct 51.

Figure 4:
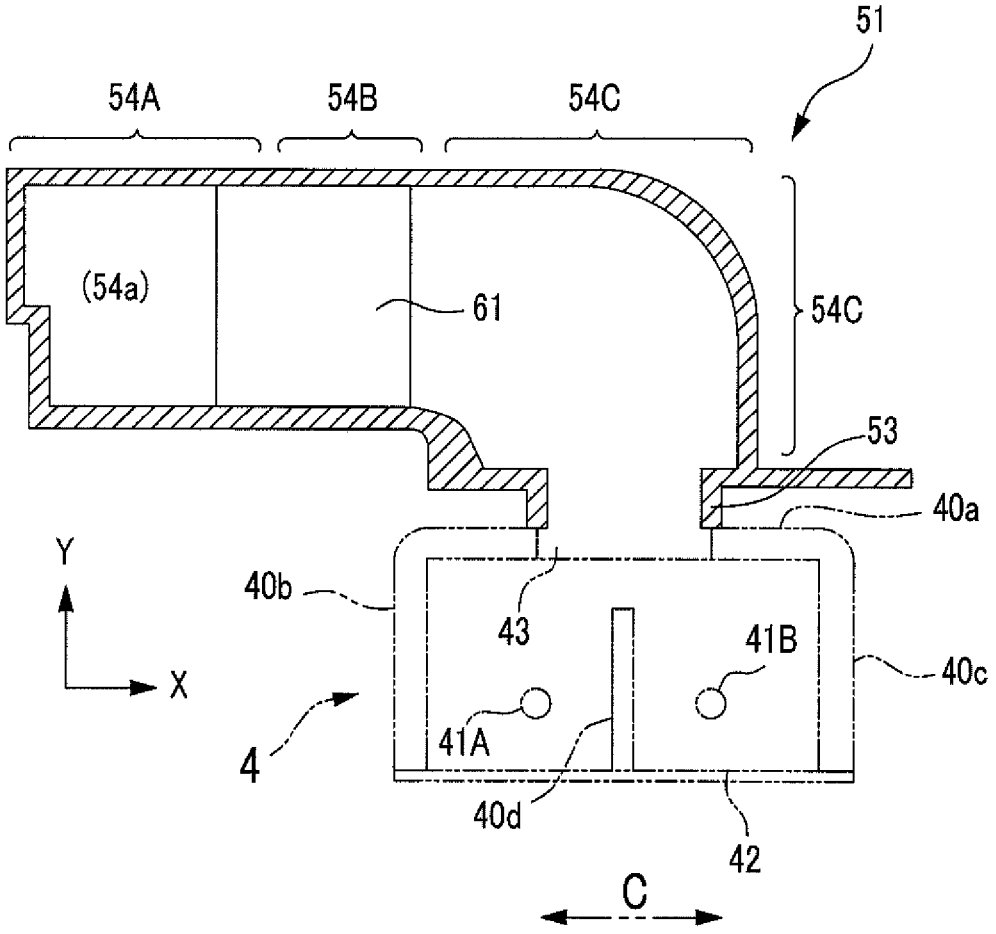
FIG. 4 is a cross-sectional configuration view showing the blowing device.

Subsequently, the air (E) taken into the blower duct 51, as shown in FIGS. 4 and 5, is distributed into the air that flows to the first blowoff region $\mathbf{62}_1$ corresponding to the first flow dividing plate 61 and blowoff regions (second to sixth blowoff regions) downstream of the first blowoff region $\mathbf{62}_1$ by the distributing portion 61*a* of the first flow dividing plate 61 arranged in the passage space 54*a* of the introduction passage portion 54A.

The air distributed to the first blowoff region $\mathbf{62}_1$ by the distributing portion 61*a* of the first flow dividing plate 61 is changed in direction along the changing portion 61*b* of the flow dividing plate 61, and is blown against the first blowoff region $\mathbf{62}_1$ from the outlet 53.

Additionally, the air distributed to the downstream blowoff regions (second to sixth blowoff regions) by the distributing portion 61*a* of the first flow dividing plate $\mathbf{61}_1$ is distributed to the air that flows to the second blowoff region $\mathbf{62}_2$ corresponding to the second flow dividing plate $\mathbf{61}_2$ and blowoff regions (third to sixth blowoff regions) downstream of the second blowoff region $\mathbf{62}_2$ by the distributing portion 61*a* of the second flow dividing plate $\mathbf{61}_2$ arranged with the gap G on the downstream side of the first flow dividing plate 61. The air distributed to the second blowoff region $\mathbf{62}_2$ is changed in direction along the changing portion 61*b* of the flow dividing plate $\mathbf{61}_2$, and is blown against the second blowoff region $\mathbf{62}_2$ from the outlet 53.

In the following, similarly, the air distributed to the downstream blowoff regions (third to sixth blowoff regions) by the distributing portion 61*a* of the second flow dividing plate $\mathbf{61}_2$ is distributed to the air that flows to the third to fifth blowoff regions $\mathbf{62}_3$ to $\mathbf{62}_5$ corresponding to the third to fifth flow dividing plates $\mathbf{61}_3$ to $\mathbf{61}_5$ and the air that flows to blowoff regions (fourth to sixth blowoff regions) downstream of the third to fifth blowoff regions $\mathbf{62}_3$ to $\mathbf{62}_5$ by the distributing portions 61*a* of the third to fifth flow dividing plates $\mathbf{61}_3$ to $\mathbf{61}_5$ that are located on the downstream side, is changed in direction along the changing portions 61*b* of the flow dividing plates 61, and are blown against the third to sixth blowoff regions $\mathbf{62}_3$ to $\mathbf{62}_6$ from the outlet 53.

In this way, the distributing portion 61*a* of each flow dividing plate 61 may simply distribute air to the air that flows to a corresponding blowoff region 62 and the air that flows to blowoff regions downstream of the blowoff region 62 concerned, is formed in the shape of a relatively short flat shape, and does not extend up to the inlet 52 of the blower duct 51. As a result, it is possible to avoid a situation in which the distributing portion 61*a* becomes flow resistance of air and pressure loss increases.

Additionally, the flow (E) of the air distributed by the distributing portion 61*a* of each flow dividing plate 61 is changed in direction to a corresponding blowoff region 62 by the changing portion 61*b* of each flow dividing plate 61. As a result, it is possible to blow air in a substantially uniform state against the corresponding blowoff region 62. Additionally, since the changing portion 61*b* of each flow dividing plate 61 changes the flow direction of air, a situation in which pressure loss increases is avoided even in the changing portion 61*b*.

From the above, all the air that comes out from the outlet 53 of the blower duct 51 is sent out in a state where the traveling direction thereof is the direction substantially orthogonal to the longitudinal direction of the outlet, and the wind speed thereof is brought into a substantially uniform state.

Accordingly, unnecessary substances, such as paper debris, an additive agent of toner, and a discharge product, that are going to adhere to the two discharging wires 41A and 41B and the grid electrode 42, respectively, can be kept away. As a result, degradation, such as unevenness, can be prevented from occurring in charging performance owing to sparse adhesion of unnecessary substances to the discharging wires 41A and 413 or the grid electrode 42 in the charging device 4, and the peripheral surface of the photoconductor drum 21 can be more uniformly (uniformly in both directions of the axial direction and the circumferential direction along the rotational direction) charged. Additionally, a toner image formed in the image forming unit 20 including the charging device 4, and an image eventually formed on a sheet 9 are obtained as excellent images in which occurrence of image defects (uneven density or the like) resulting from poor charging, such as uneven charging, is reduced.

Experiment Example

Figures 7A, 7B:
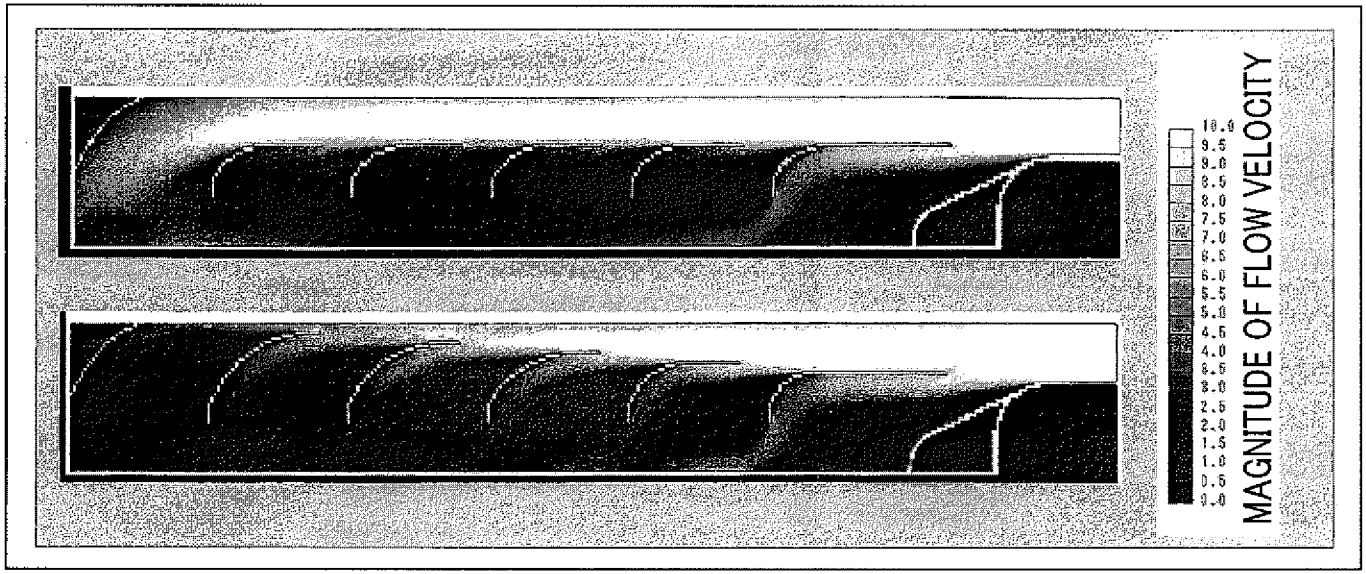
FIGS. 7A and 7B are views showing experimental results.

FIGS. 7A and 7B show the experimental results of the performance characteristics of the blowing device 5 that are obtained by simulation using a computer.

Experiment is performed by obtaining the distribution of wind speed in the longitudinal direction of the outlet 53 by simulation using a computer when the shape and dimensions of the blower duct 51 shown in FIG. 5 is put into a program that performs the simulation and air with a uniform speed is introduced from the inlet 52 of the blower duct 51. In addition, the wind speed is a value at a position of 2 mm from a lower portion of the outlet 53 at a central portion in the direction orthogonal to the longitudinal direction.

As the blower duct 51, there is a blower duct in which the overall shape is that as shown in FIG. 3 to FIG. 6, the inlet 52 has a substantially square opening shape of 22 mm×23 mm, and the outlet 53 has an oblong opening shape of 17.5 mm×350 mm.

Figure 8:
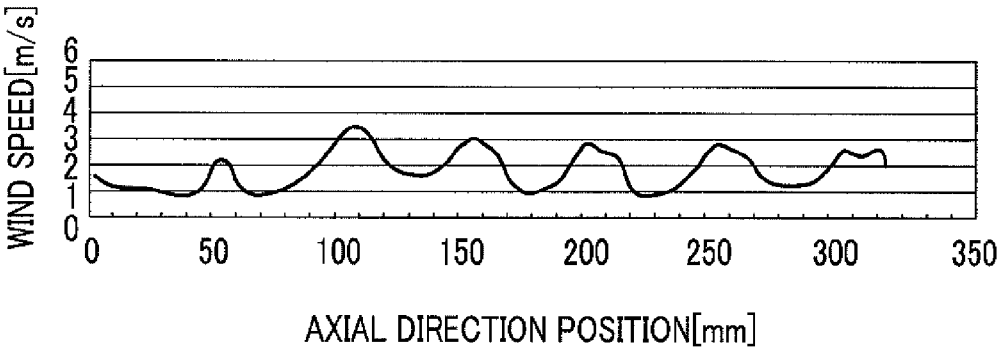
FIG. 8 is a graph showing experimental results.

As shown in FIG. 8, although the wind speed in the longitudinal direction of the outlet 53 of the blower duct 51 are seen as peaks and valleys (increase and decrease) with narrow pitches corresponding to the flow dividing plates 61, the wind speed is within a range of about 1 to 3 m/s along the longitudinal direction B of the charging device 4, and does not become high at one end portion along the longitudinal direction B of the charging device 4, and excellent results are obtained.

In addition, the peaks and valleys (increase and decrease) with the narrow pitches corresponding to the flow dividing plates 61 can be leveled into a substantially uniform state at the outlet 53 of the blower duct 51 or at a portion closer to the downstream side than the outlet 53. In contrast, in velocity distribution showing the tendency that the wind speed becomes high at one end portion along the longitudinal direction B of the charging device 4, it is difficult to make the wind speed uniform at the portion closer to the downstream side than the outlet 53, and the wind speed remains as it is. Therefore, this poses a problem.

Comparative Example

A blower duct of Comparative Example, as shown in FIG. 7A, has a configuration in which the distributing portions 61*a* of the respective flow dividing plates 61 are arranged at the same position in the direction orthogonal to the longitudinal direction of the charging device 4, without being shifted in the direction orthogonal to the longitudinal direction of the charging device 4.

Figure 9:
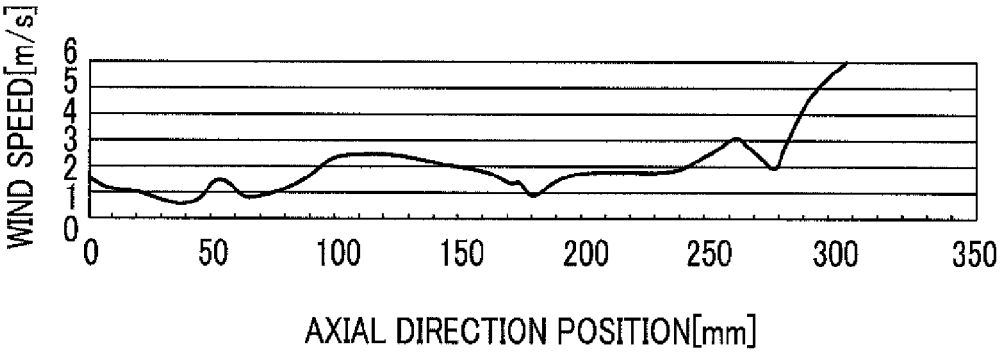
FIG. 9 is a graph showing experimental results.

FIG. 9 is a graph showing results when measuring the speed (wind speed) of a flow of air that blows off from an outlet.

As is clear from FIG. 9, it can be seen in the blower duct 51 of Comparative Example that the wind speed on the inlet 52 side is relatively slow, whereas the wind speed nearest to the downstream side becomes abruptly fast, and as a result, the wind speed distribution has a large inclination along the longitudinal direction of the charging device 4.

Second Exemplary Embodiment

Figure 10A:
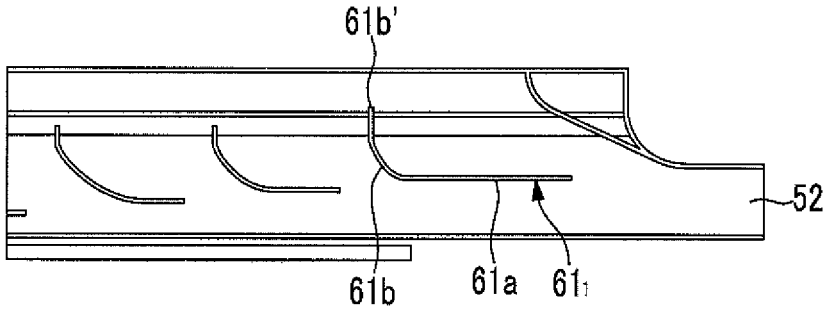
FIGS. 10A and 10B are configuration views of main portions showing a blowing device related to a second exemplary embodiment of the invention.
Figure 10B:
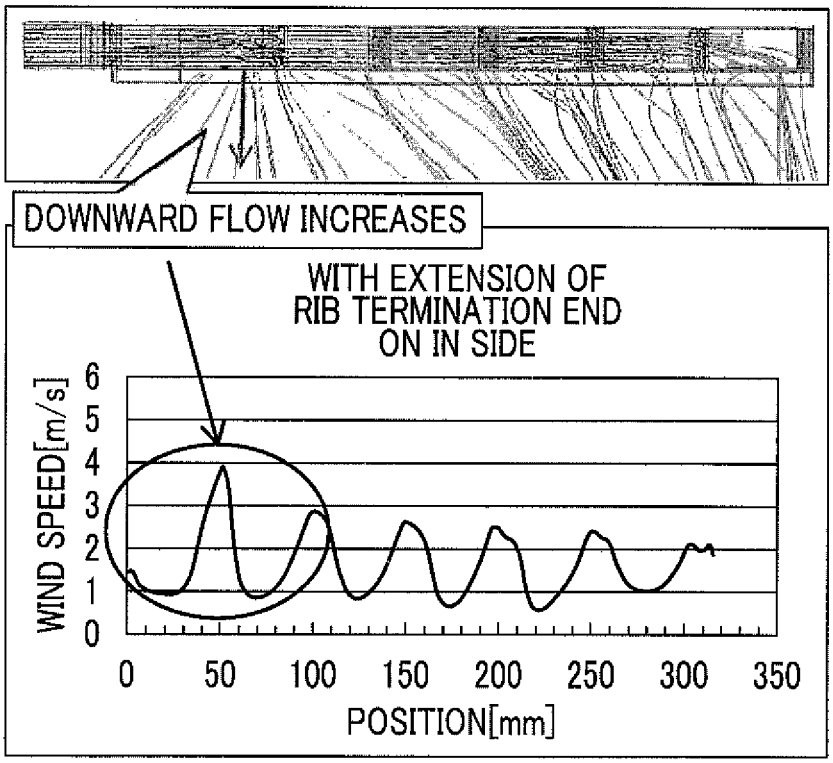

FIGS. 10A and 10B show a blowing device related to the second exemplary embodiment, and shows a blower duct in the blowing device.

In the blower duct 51, as shown in FIG. 10A, the rear end portion 61*b*' of the changing portion 61*b* of the first flow dividing plates 61 nearest to the inlet 52 is arranged to extend toward the outlet 53 from the second bent passage portion 54C.

Figure 11A:
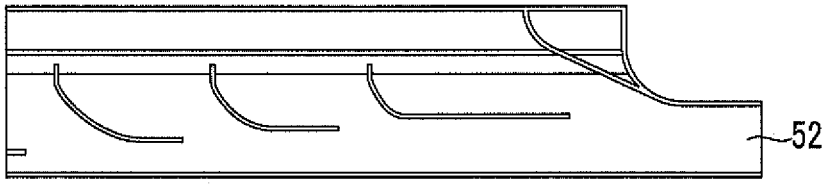
FIGS. 11A and 11B are configuration views of main portions showing a blowing device related to a first exemplary embodiment.
Figure 11B:
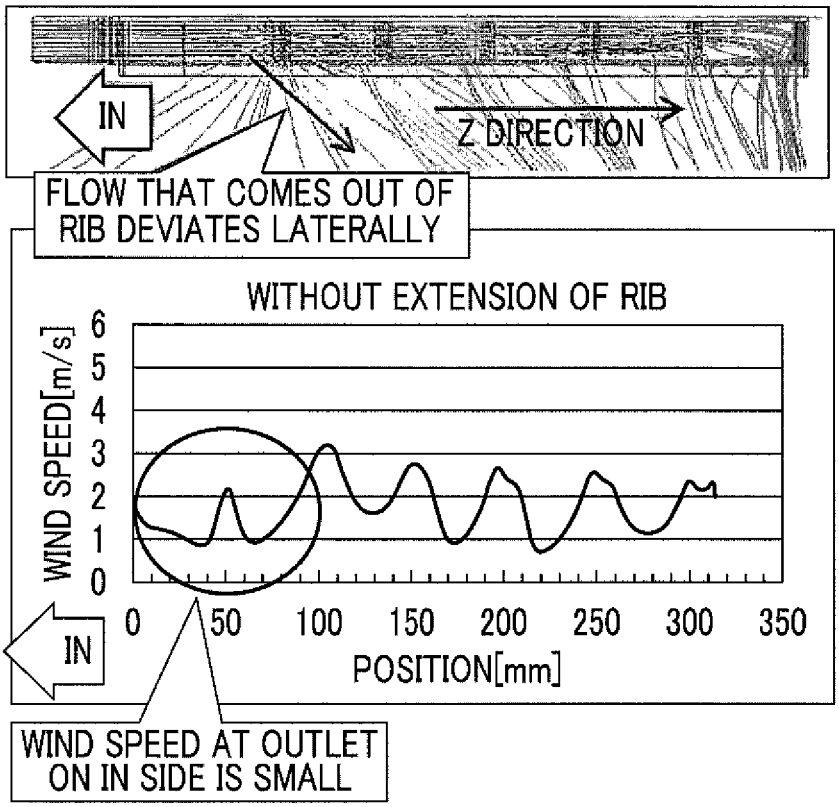

As shown in FIGS. 11A and 11B, the first flow dividing plate 61 is arranged at a position nearest to the inlet 52, and the speed (wind speed) of the flow of air distributed by the flow dividing plate 61 is faster as compared to the other flow dividing plates. Therefore, even after the direction of the air distributed to the first blowoff region 62 by the first flow dividing plate is changed to the direction orthogonal to the longitudinal direction B of the charging device 4 by the changing portion 61*b* of the first flow dividing plate 61, the flow of a component in the longitudinal direction B of the charging device 4 remains strong.

As a result, if the wind speed of the outlet 53 of the blower duct 51 is obtained, there is a tendency that the wind speed of a region corresponding to the first flow dividing plate $\mathbf{61}_1$ becomes relatively low as compared to the other flow dividing plates.

Thus, in this exemplary embodiment, as shown in FIGS. 10A and 10B, the rear end portion of the changing portion of the first flow dividing plate nearest to the inlet 52 is arranged so as to extend to the outlet 53 from the second bent passage portion. It is thereby possible to keep the flow of the air distributed by the first flow dividing plate from deviating to the downstream regions, and it is possible to avoid a situation in which the wind speed of the region corresponding to the first flow dividing plate becomes relatively low as compared to the other flow dividing plates.

FIG. 10B shows a graph showing the results when the wind speed of air that flows from the outlet 53 in a case where the blower duct 51 related to the second exemplary embodiment is used is obtained by simulation.

As is clear from this drawing, the rear end portion 61*b*' of the changing portion 61*b* of the first flow dividing plate $\mathbf{61}_1$ is arranged so as to extend toward the outlet 53 from the second bent passage portion 54C. It is thereby possible to avoid a situation in which the wind speed of the region corresponding to the first flow dividing plate $\mathbf{61}_1$ becomes relatively low as compared to the other flow dividing plates.

In addition, in the example shown in FIG. 10B, the wind speed of the region corresponding to the first flow dividing plate $\mathbf{61}_1$ is relatively fast as compared to the other flow dividing plates. However, by adjusting the length by which the rear end portion of the changing portion of the first flow dividing plate extend (so as to be short), it is possible to make the wind speed of the region corresponding to the first flow dividing plate $\mathbf{61}_1$ approximately equal to those of the other flow dividing plates.

Additionally, when the wind speed of regions corresponding to plural flow dividing plates 61 becomes relatively low as compared to the other flow dividing plates, the rear end portions of the changing portions 61*b* of the plural flow dividing plate 61 are arranged so as to extend toward the outlet 53 from the second bent passage portion 54C. It is thereby possible to keep the flow of the air distributed by the changing portions 61*b* of the plural flow dividing plate 61 from deviating to the downstream regions, and it is possible to avoid a situation in which the wind speed of the regions corresponding to the plural flow dividing plates 61 becomes relatively low as compared to the other flow dividing plates.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blowing device comprising:

a blower that sends air;

a blower pipe having an inlet that takes in the air sent from the blower, an outlet that is arranged so as to face a portion, in the longitudinal direction, of an elongated target structure against which the air taken in from the inlet is to be blown and that is formed in an elongated opening shape parallel to the portion of the target structure in the longitudinal direction, and a body portion that connects the inlet and the outlet and to cause the air to flow therethrough; and a plurality of flow dividing plates, each of the flow dividing plates having a distributing portion that has an edge, the edge being arranged at an upstream side of the distributing portion, and is arranged so as to be substantially parallel to the longitudinal direction of the elongated target structure and distributes the air taken in from the inlet, and a changing portion that is arranged so as to be substantially orthogonal to the longitudinal direction of the elongated target structure and changes the direction of the flow of air distributed by the distributing portion, wherein each of the edge positions of the distributing portions is different from each other in position along the longitudinal direction, and each of the flow dividing plates does not overlap others of the flow dividing plates in the longitudinal direction.

2. The blowing device according to claim 1, wherein each distance along the longitudinal direction from a wall of the body portion to the edge of a distributing portion of each flow dividing plate differs from each other.

3. The blowing device according to claim 1, wherein a rear end of the changing portion of at least one of the flow dividing plates excluding the flow dividing plate arranged nearest to the downstream side among the respective flow dividing plates extends toward the outlet side from a passage space.

4. The blowing device according to claim 1, wherein a rear end of the changing portion of the flow dividing plate arranged nearest to the upstream side among the respective flow dividing plates extends toward the outlet side from a passage space.

5. The blowing device according to claim 1, wherein a rear end of the changing portion of the most upstream side flow dividing plate among the plurality of flow dividing plates is arranged most downstream among the respective changing portions in a direction orthogonal to the longitudinal direction, and the edge of the distributing portion of portion of the most upstream side flow dividing plate is arranged nearest to the upstream side among the respective flow dividing plates.

6. The blowing device according to claim 1, further comprising an inclination wall, wherein the inclination wall is provided to extend from a side wall of an introduction passage portion via a first bent passage portion to a second bent passage portion.

7. The blowing device according to claim 1, wherein the distributing portion of a flow dividing plate being nearest to the upstream side along the longitudinal direction of the elongated target structure is longer than the distribution portion of the others of the flow dividing plates among the plurality of flow dividing plates.

8. The blowing device according to claim 2, wherein a rear end of the changing portion of at least one of the flow dividing plates excluding the flow dividing plate arranged nearest to the downstream side among the respective flow dividing plates extends toward the outlet side from a passage space.

9. The blowing device according to claim 2, wherein a rear end of the changing portion of the flow dividing plate arranged nearest to the upstream side among the respective flow dividing plates extends toward the outlet side from a passage space.

10. An image forming apparatus comprising:

an elongated target structure against which air is to be blown; and a blowing device that blows air toward a portion of the target structure in a longitudinal direction, the blowing device according to claim 1 is used as the blowing device.

11. An image forming apparatus comprising:

an elongated target structure against which air is to be blown; and a blowing device that blows air toward a portion of the target structure in a longitudinal direction, the blowing device according to claim 2 is used as the blowing device.

* * * * *